US006956594B2

(12) United States Patent
Iida et al.

(10) Patent No.: US 6,956,594 B2
(45) Date of Patent: Oct. 18, 2005

(54) IMAGE FORMING APPARATUS INCLUDING TWO IMAGE BEARING MEMBERS AND FEATURING A VARIABLE DOT IMAGE

(75) Inventors: Kenichi Iida, Boise, ID (US); Tatsunori Ishiyama, Shizuoka (JP); Yasuo Yoda, Shizuoka (JP)

(73) Assignee: Canon Kabushik Kaisha, Tokyo (JP)

( * ) Notice: Subject to any disclaimer, the term of this patent is extended or adjusted under 35 U.S.C. 154(b) by 32 days.

(21) Appl. No.: 10/661,589

(22) Filed: Sep. 15, 2003

(65) Prior Publication Data

US 2004/0114948 A1 Jun. 17, 2004

(30) Foreign Application Priority Data

Sep. 24, 2002 (JP) ..... 2002-278186

(51) Int. Cl.[7] ..... B41J 2/385; G03G 13/04; G03G 15/00; G03G 15/01

(52) U.S. Cl. ..... 347/131; 399/45; 399/302

(58) Field of Search ..... 399/302, 72, 43–45; 347/131, 254

(56) References Cited

U.S. PATENT DOCUMENTS

| | | | | | |
|---|---|---|---|---|---|
| 4,896,173 | A | * | 1/1990 | Shimada et al. | 347/131 |
| 5,045,869 | A | * | 9/1991 | Isaka et al. | 347/254 |
| 6,091,922 | A | | 7/2000 | Bisaiji | 399/297 |
| 6,212,351 | B1 | * | 4/2001 | Kawagoe et al. | 399/302 |
| 6,259,879 | B1 | | 7/2001 | Bisaiji | 399/296 |
| 6,434,354 | B2 | | 8/2002 | Bisaiji | 399/296 |
| 2001/0007616 | A1 | | 7/2001 | Bisaiji | 399/296 |

FOREIGN PATENT DOCUMENTS

| | | |
|---|---|---|
| JP | 6-317992 | 11/1994 |
| JP | 11-52728 | 2/1999 |
| JP | 11-249459 | 9/1999 |

* cited by examiner

*Primary Examiner*—Susan Lee
(74) *Attorney, Agent, or Firm*—Fitzpatrick, Cella, Harper & Scinto

(57) ABSTRACT

The image forming apparatus includes, a movable first image bearing member on which a toner image is formed; and a movable second image bearing member which is brought into contact with the first image bearing member and to which the toner image on the first image bearing member is transferred, in which the toner image on the second image bearing member is transferred onto a transferring material, a dot-shaped dot image formed of a toner different from the toner image is formable on the first image bearing member, and the dot image is variable according to a condition upon forming the toner image on the transferring material. Thus, there is provided an image forming apparatus capable of forming a final image with a high quality in a stable manner independently of a selection of a type of transferring materials or image quality mode as well as suppressing an image streak occurrence.

21 Claims, 6 Drawing Sheets

PATTERN C

IMAGE FORMING APPARATUS INCLUDING TWO IMAGE BEARING MEMBERS AND FEATURING A VARIABLE DOT IMAGE

BACKGROUND OF THE INVENTION

1. Field of the Invention

The present invention relates to an image forming apparatus such as a copying machine or a printer for transferring onto a recording material a toner image formed on an image bearing member using, for instance, an electrophotographic process and subsequently fixing the toner image to form a permanent image on the recording material.

2. Related Background Art

Up to now, as color image forming apparatuses capable of outputting a full color image, apparatuses having the following structure have been put in practical use. That is, at a first transferring area formed in a contact part between an image bearing member surface and an intermediate transferring body surface, a first transferring bias is applied to a first transferring member disposed on a rear side of the intermediate transferring body to temporarily transfer onto the intermediate transferring body surface a toner image on the image bearing member surface (hereinafter, referred to as primary transfer). After that, a transferring material passes through a second transferring area formed at a contact part between the intermediate transferring body and a second transferring member to apply a second transferring bias thereto, so that the toner image on the intermediate transferring body surface is transferred again onto the transferring material (hereinafter, referred to as secondary transfer).

FIG. 8 shows an example of the color image forming apparatus having the above structure. Now, referring to FIG. 8, a description will be given of an operation of the image forming apparatus having the above structure.

In the image forming apparatus of this example, image exposure using a laser beam L is applied from an exposure apparatus 103 through a reflection mirror 104 onto a rotation drum type electrophotographic photosensitive member (hereinafter, referred to as photosensitive drum) 101 as the image bearing member rotating in a direction of an arrow R1, which is uniformly charged by a charger 102. Then, latent images corresponding to target color images are formed on an exposure area A.

Next, the latent images are developed by developing devices 105 (yellow developing device 105Y, magenta developing device 105M, cyan developing device 105C, and black developing device 105Bk) to thereby form a yellow toner image, a magenta toner image, a cyan toner image, and a black toner image on the photosensitive drum 101, respectively. The yellow toner image, the magenta toner image, the cyan toner image, and the black toner image are superposed in order on a surface of an intermediate transferring belt 106 at a primary transferring nip part B as a primary transferring area between a primary transferring roller 107 and the photosensitive drum 101 and primarily transferred thereonto. This primary transfer was carried out while the intermediate transferring belt 106 makes four rotations in a direction of an arrow R2. The toner images of full color thus superposed on the intermediate transferring belt 106 are collectively secondarily transferred as the full color toner image corresponding to a target color image onto a transferring material P fed to a secondary transferring nip part C as a secondary transferring area between a secondary transferring roller 108 and a secondary-transferring opposing roller 106*b*. The transferring material P, after undergoing the secondary transfer, is transported to a fixing device 115 where the toners of four colors are melted for color mixture by applying a pressure and heat thereto and fixed onto the transferring material P. Thus, a full-color final image is formed on the transferring material P.

After the above process is completed, a secondary transfer residual toner on the intermediate transferring belt 106 is removed by an intermediate transferring belt cleaner 109. In addition, a primary transfer residual toner on the photosensitive drum 101 is collected by a cleaner 110 and used for a subsequent cycle.

Note that in such an image forming apparatus, a laser beam scanning direction is called a main scanning direction (direction perpendicular to a direction in which the photosensitive drum moves), whereas the directions of the arrows R1 and R2 in which the photosensitive drum 101 and the intermediate transferring belt 106 rotate, respectively are each called a sub-scanning direction.

For the purpose of further improving an image quality of a final image obtained by the above image forming apparatus, however, the inventors of the present invention have made various studies on the image forming apparatus of such a type and found that, upon primarily transferring the toner image formed on the photosensitive drum 101 surface onto the intermediate transferring belt 106 surface, an abrupt rotation variation of the photosensitive drum 101 may occur, which causes an exposure unevenness of the laser exposure L. This leads subsequently to an image streak occurring on the toner image formed on the photosensitive drum 101 surface.

This is because under such a condition that no toner is within the primary transferring nip part B formed by the photosensitive drum 101 and the intermediate transferring belt 106, when a leading end of the toner image developed onto the photosensitive drum 101 comes into the primary transferring nip part, a frictional force acting on the photosensitive drum 101 surface from the intermediate transferring belt 106 surface abruptly drops.

To cope with the above problem, the following method has been known. That is, in addition to a toner image of an image pattern that the user demands, a minute dot-shaped toner image is formed additionally on the photosensitive drum 101 with a yellow toner or the like. As a result, the rotation variation of the photosensitive drum 101 and the intermediate transferring belt 106 is suppressed to thereby avoid various types of image failure.

For example, in an image forming apparatus disclosed in Japanese Patent Application Laid-Open No. 11-52758, minute dot toner images are formed on the photosensitive drum through a uniform dispersion to prevent a color drift from occurring on the toner image primarily transferred onto the intermediate transferring belt.

Similarly, in the image forming apparatus configured as shown in FIG. 8, such dot toner images are formed to make the photosensitive drum 101 surface and the intermediate transferring belt 106 surface smooth to each other at the primary transferring nip part B. Hence, the frictional force is reduced in advance, thereby making it possible to eliminate the exposure unevenness resulting from the rotation variation and to prevent the image streak occurrence.

However, upon printing on a transferring material such as coat paper, glossy paper, or a glossy film, if the image formation is performed by additionally forming the dot toner images, the additionally formed dot toner images are conspicuous on the transferring material and the transferring material looks yellowish throughout, which causes a problem in that the image quality is degraded in some cases. This is because the transferring material is high in surface smoothness and superior in secondary transferring property. Therefore, the yellow dot toner image is wholly represented on the transferring material, which is primarily transferred onto the intermediate transferring belt 106 to make the photosensitive drum 101 surface and the intermediate transferring belt 106 surface smooth to each other to thereby reduce the frictional force.

Also at the time of printing at a printing speed lower than usual for the purpose of obtaining a high-quality final image on the various types of transferring materials with a fixability, glossiness, and resolution higher than usual, the additionally formed dot toner images are conspicuous on the transferring material, which accordingly looks yellowish throughout. This causes a problem in degraded image quality. This is because the printing speed falls and hence, the fixability as well as the secondary transferring property are improved. Therefore, the yellow dot toner image fixed onto the transferring material supposedly appears with the increased surface glossiness.

SUMMARY OF THE INVENTION

An object of the present invention is to provide an image forming apparatus capable of forming a final image with a high quality in a stable manner independently of a selection of a type of transferring materials or image quality mode as well as suppressing an image streak occurrence.

Another object of the present invention is to provide an image forming apparatus including: a movable first image bearing member on which a toner image is formed; and a movable second image bearing member which is brought into contact with the first image bearing member and to which the toner image on the first image bearing member is transferred, in which: the toner image on the second image bearing member is transferred onto a transferring material; a dot-shaped dot image formed of a toner different from the toner image is formable on the first image bearing member; and the dot image is variable according to a condition upon forming the toner image on the transferring material.

Further objects of the present invention will be apparent upon reading the following description.

DETAILED DESCRIPTION OF THE PREFERRED EMBODIMENTS

Hereinafter, an image forming apparatus according to the present invention will be described with reference to the accompanying drawings.

(Embodiment 1)

Figure 1:
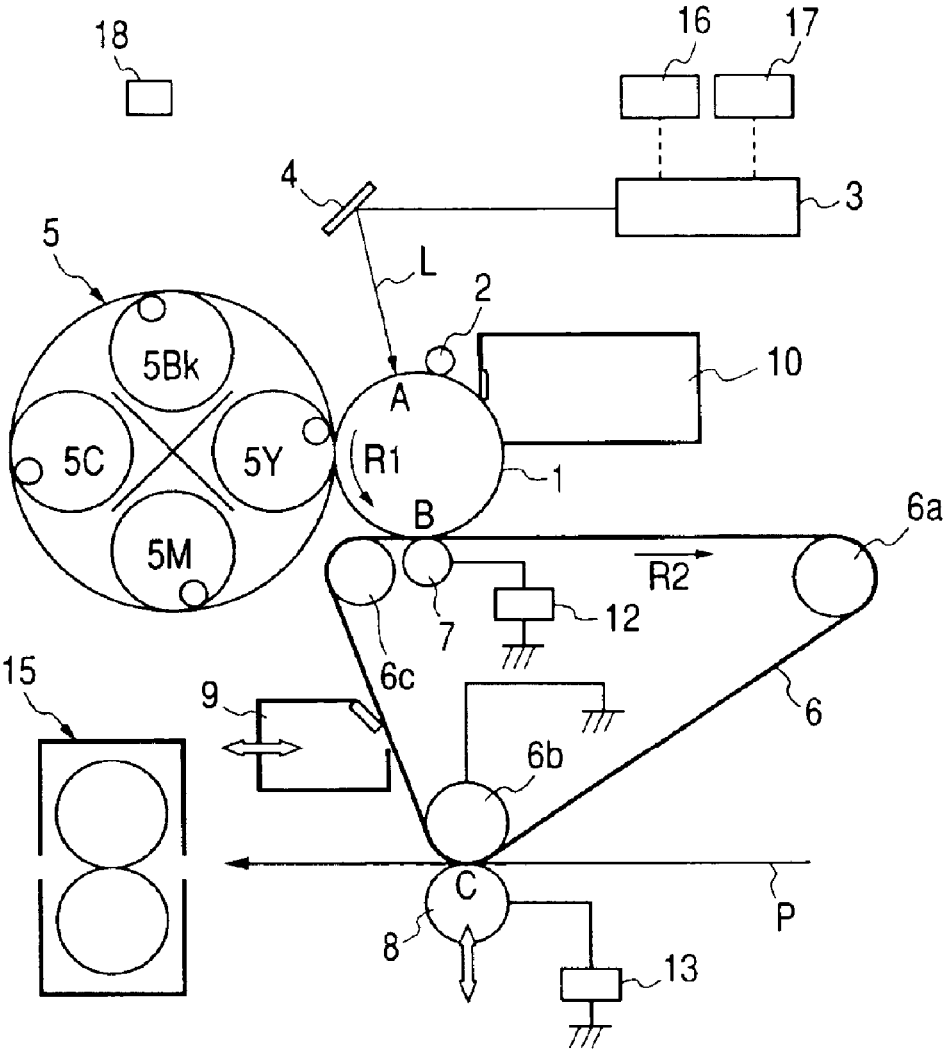
FIG. 1 shows an image forming apparatus according to an embodiment of the present invention.

The present invention can be embodied in an image forming apparatus such as a laser printer of an electrophotographic process shown in FIG. 1. A description will be given of an entire structure of the image forming apparatus according to an embodiment of the present invention below.

In the image forming apparatus according to this embodiment, image exposure using a laser beam L is applied from an exposure apparatus 3 through a reflection mirror 4 onto a rotation drum type electrophotographic photosensitive member (hereinafter, referred to as photosensitive drum) 1 as a first image bearing member rotating in a direction of an arrow R1, which is uniformly charged by a charger 2. Then, latent images corresponding to target color images are respectively formed on an exposure area A.

Next, the latent images are developed by a developing device 5 (yellow developing device 5Y, magenta developing device 5M, cyan developing device 5C, and black developing device 5Bk) to thereby form a yellow toner image, a magenta toner image, a cyan toner image, and a black toner image on the photosensitive drum 1, respectively. The yellow toner image, the magenta toner image, the cyan toner image, and the black toner image are superposed in order on a surface of an intermediate transferring belt 6 as a second image bearing member at a primary transferring nip part B as a primary transferring area between a primary transferring roller 7 and the photosensitive drum 1 and primarily transferred thereonto. This primary transfer was carried out while the intermediate transferring belt 6 makes four rotations in a direction of an arrow R2. The toner images of full color thus superposed on the intermediate transferring belt 6 are collectively secondarily transferred as the full color toner image corresponding to a target color image onto a transferring material P as a recording material fed to a secondary transferring nip part C as a secondary transferring area between a secondary transferring roller 8 and a secondary-transferring opposing roller 6*b*. The transferring material P, after undergoing the secondary transfer, is transported to a fixing device 15 where the toners of four colors are melted for color mixture by applying a pressure and heat thereto and fixed onto the transferring material P. Thus, a full-color final image is formed on the transferring material P. Note that, the intermediate transferring belt 6 is interposed between the photosensitive drum 1 and the primary transferring roller 7 at the primary transferring nip part B and is brought into contact with the photosensitive drum 1.

The intermediate transferring belt 6 is stretched by a drive roller 6*a*, the secondary-transferring opposing roller 6*b*, and a tension roller 6*c* and rotates in the direction of the arrow R2 through the rotation of the drive roller 6*a*. The drive roller 6*a* is composed of a core metal on which a surface layer made of a rubber material is formed. Also, the intermediate transferring belt 6 used is a resin- or rubber-made seamless belt. Note that in such an image forming apparatus, a laser beam scanning direction is called a main scanning direction (direction perpendicular to a direction in which the photosensitive drum moves), whereas the directions of the arrows R1 and R2 in which the photosensitive drum 1 and the intermediate transferring belt 6 move (rotate), respectively are each called a sub-scanning direction.

Next, the above primary and secondary transferring processes will be described.

If the photosensitive drum 1 is an OPC photosensitive member of a negative polarity, for instance, the toner of the negative polarity is used for a case where an exposure part on the photosensitive drum 1 after the image exposure L is subjected to the development using the developing devices 5 (yellow developing device 5Y, magenta developing device 5M, cyan developing device 5C, and black developing device 5Bk). Accordingly, a transferring bias of a positive polarity is applied from a transfer high-voltage power supply 12 to the primary transferring roller 7 as a first transferring member. Upon the secondary transfer using the secondary transferring roller 8 as a second transferring member, the secondary-transferring opposing roller 6*b* with the rear side being grounded or with the appropriate bias being applied thereto is set as an opposing electrode. In this state, the positive-polarity bias is applied from the high-voltage power supply 13 to the secondary transferring roller 8. Thus, the roller is brought into contact therewith from the rear side of the transferring material P.

After the above process is completed, a secondary transfer residual toner on the intermediate transferring belt 6 is removed by an intermediate transferring belt cleaner 9. In addition, a primary transfer residual toner on the photosensitive drum 1 is collected by a cleaner 10 and used for a subsequent cycle.

In this embodiment, a process speed is set to 117 mm/sec and a resolution is set to 600 dpi in the image forming apparatus shown in FIG. 1.

Note that in this embodiment, the photosensitive drum 1 as the first image bearing member is composed of an aluminum cylinder on which an ordinary electrophotographic photosensitive layer formed of polycarbonate is formed, with a diameter of 50 mm. The intermediate transferring belt 6 as the second image bearing member is a single-layer seamless resin belt with a thickness of 75 $\mu$m, which is formed of polyimide after resistivity adjustment through a carbon dispersion. A volume resistivity $\rho v$ is $10^9$ $\Omega$cm at the time of applying a voltage of 100 V. The primary transferring roller 7 is formed of conductive urethane foam in which an ion conductive agent is molecular-dispersed. A foam layer is formed with a thickness of 4 mm on an SUS core metal having a diameter of 8 mm and an outer diameter thereof is 16 mm. From a calculation based on a relation with a current measured under the conditions that a load of 4.9 N is applied to both ends, the roller is rotated at a peripheral velocity of 50 mm/sec with respect to a rotational aluminum cylinder that is grounded, and the core metal thereof is applied with the voltage of 100 V, a resistivity is $5\times10^6$ $\Omega$. Regarding the primary transferring roller 7, its own weight is 160 g. The primary transferring roller 7 is brought into contact with the photosensitive drum 1 through the intermediate transferring belt 6 by means of a spring for applying 500 gf (4.9 N) to both the ends, thus forming the primary transferring nip part B.

The inventors of the present invention have made various experiments on the above image forming apparatus using the photosensitive drum and the intermediate transferring belt and evaluated an image obtained by the above image forming apparatus. As a result, as also described above, it is found that any image streak may occur in the toner image primarily transferred onto the intermediate transferring belt surface, which causes the deteriorated final image quality.

(Regarding a Cause of Generating the Image Streak)

As is apparent from additional studies by the inventors of the present invention, the foregoing image streak occurs due to an abrupt variation in peripheral velocity of the photosensitive drum and the intermediate transferring belt.

Figure 2:
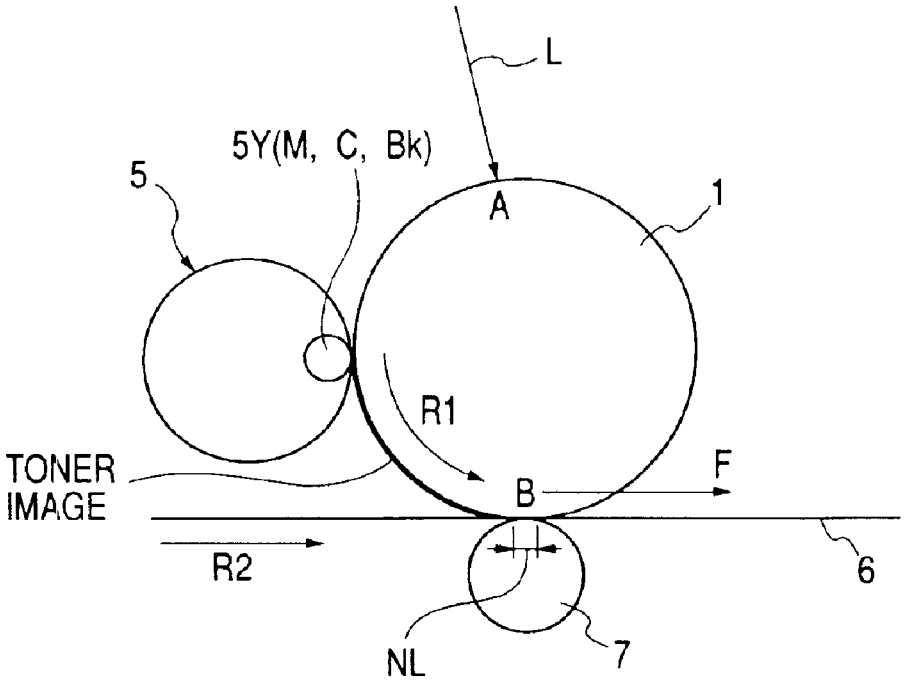
FIG. 2 is an enlarged view showing vicinities of a primary transferring part.

In particular, it is found that the abrupt variation and the image streak occur by the following causes. FIG. 2 is an enlarged view showing vicinities of the primary transferring part of the image forming apparatus of this embodiment. The intermediate transferring belt 6 is rotated in the direction of the arrow R2 at a surface peripheral velocity which is about 0.5% higher than that of the photosensitive drum 1 rotated in the direction of the arrow R1 during printing. That is, the photosensitive drum 1 and the intermediate transferring belt 6 differ in moving velocity at the contact part (primary transferring nip part B). This is because, as disclosed, for example, in Japanese Patent Application Laid-Open Nos. 11-249459 and 6-317992, the transfer is performed utilizing such a shear force as to wipe the toner image out of the photosensitive drum 1, so that a transferring efficiency upon the primary transfer is improved and a hollow line or character image is prevented.

Figure 3:
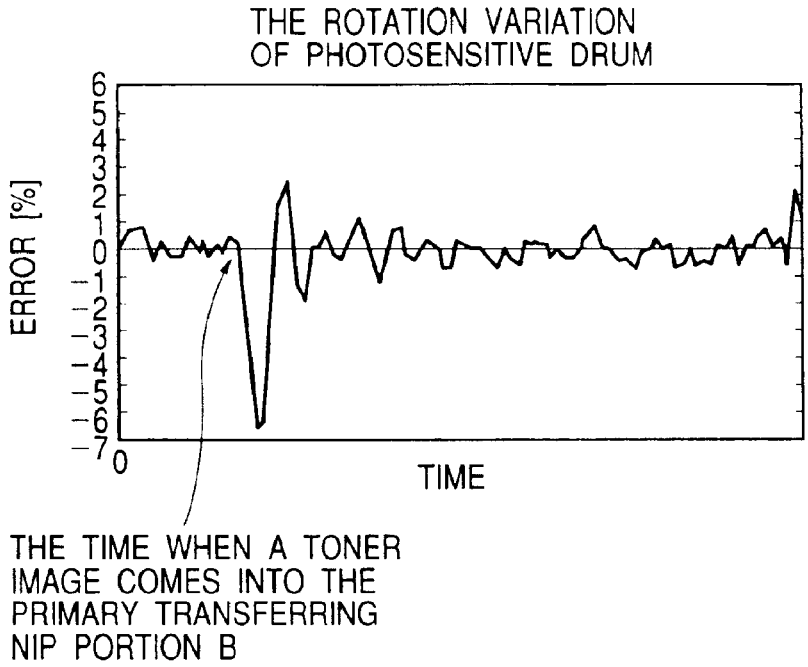
FIG. 3 shows a rotation variation of a photosensitive drum.

Under such circumstances, if the toner is not within the primary transferring nip part B, on the photosensitive drum 1 surface, a frictional force F acts tangentially (in the sub-scanning direction) from the intermediate transferring belt 6 surface toward a downstream side thereof. However, when a leading end of the toner image developed onto the photosensitive drum 1 comes into the primary transferring nip part B, the frictional force F abruptly decreases down to almost 0. This is because the toner is supplied into the primary transferring nip part B, so that the photosensitive drum 1 surface and the intermediate transferring belt 6 surface are made smooth to each other. Therefore, as shown in FIG. 3, the sudden rotation variation of the photosensitive drum 1 occurs and hence, the laser exposure L is applied to the photosensitive drum 1 surface with any writing unevenness, which leads subsequently to the image streak in the main scanning direction on the toner image formed on the photosensitive drum 1 surface. This image streak appears also on the final image.

Figure 4:
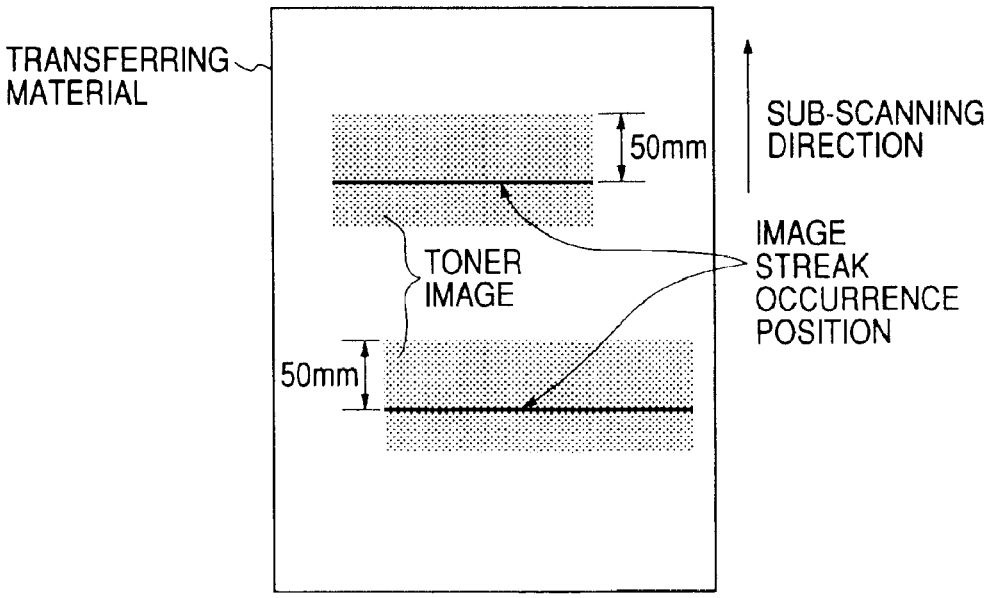
FIG. 4 shows an image streak on a transferring material outputted from the image forming apparatus.

Note that, as shown in FIG. 4, in the final image formed on the transferring material, such an image streak appears on the toner images arranged in the image pattern, at a position of about 50 mm below a top of each toner image in the sub-scanning direction (on the downstream side thereof), which corresponds to a distance between the laser exposure part A and the primary transferring part B. In particular, the image streak conspicuously appears in the case where a halftone toner image portion easily affected by the laser exposure unevenness is at the above position.

As described above, the above frictional force F involves the variation with time intermittently according to the image pattern that the user demands, with the result that the image streak occurs on the final image due to the rotation variation of the photosensitive drum 1.

(Regarding the Additional Formation of the Dot Toner Image)

As is understood from the above, provided that the frictional force F between the photosensitive drum 1 and the intermediate transferring belt 6 at the primary transferring nip part B can be reduced in advance, even when the leading end of the toner image comes into the primary transferring nip part B, the rotation variation of the photosensitive drum 1 can be suppressed. Hence, it is possible to avoid the occurrence of such an image streak as to degrade the image quality.

In the image forming apparatus of this embodiment, based on the above proviso, at the primary transferring nip part B where the toner image on the photosensitive drum 1 is transferred onto the intermediate transferring belt 6, another toner different from the toner image is intervened in advance to impart the smoothness to the photosensitive drum 1 surface and the intermediate transferring belt 6 surface, thereby reducing the frictional force to prevent the image streak from occurring. This is realized as follows. That is, an additional toner image (dot image formed of the toner) according to information different from that of the image pattern that the user demands as the final image, i.e., the image pattern corresponding to image data of each color outputted from an image processing unit 16 is intervened at the primary transferring nip part B together with the above toner image.

Note that if the additional toner image based on the additional information is formed at the primary transferring nip part B, the additional toner image is finally transferred onto the transferring material P as well. As a result, depending on an image condition of the additional toner image, the final image is damaged by the additional toner image and the final image quality is considerably degraded. To cope therewith, in the image forming apparatus of this embodiment, using dot toner image forming means as described below, minute dot toner images (dot images formed of the toner) invisible to the user's eyes are formed on the photosensitive drum 1 surface, with a dot size of approximately 1 pixel (42 $\mu$m×42 $\mu$m).

Upon the formation of the above dot toner image on the photosensitive drum 1, an appropriate average printing ratio varies among the image forming apparatuses depending on a contact force of the primary transferring roller 7 to the photosensitive drum 1, the difference of the peripheral velocity between the photosensitive drum 1 surface and the intermediate transferring belt 6 surface, and the like. In the image forming apparatus of this embodiment, however, the average printing ratio of the image data is about 0.05 to 1%, provided that the ratio of the completely black image is 100% and that of the completely white image is 0%.

(Regarding an Embodiment Mode of the Dot Toner Image Additional Formation)

Incidentally, the foregoing dot toner image can be formed on the photosensitive drum 1 surface in various modes and transferred onto the intermediate transferring belt 6 surface.

In the image forming apparatus of this embodiment, when a toner image of a first color is set as a yellow toner image and formed on the photosensitive drum 1, the above-mentioned dot toner image independent of the image information of this toner image is formed simultaneously on the photosensitive drum 1 with the yellow toner. Thus, the yellow toner image and the dot toner image are primarily transferred to an image region of the intermediate transferring belt 6 together by the action of the primary transferring roller 7 applied with the transferring bias.

In this case, the image data of the first color processed by the image processing unit 16 in the image forming apparatus of this embodiment is used together with the data for the dot toner image formed by a dot toner image forming unit 17. Based on the data, an ON/OFF control is performed on the image exposure using the laser beam L emitted from an exposure apparatus 3. Accordingly, on the photosensitive drum 1, an electrostatic latent image for the toner image of the first color and that for the dot toner image are formed together, which are visualized as the toner image with the yellow toner by the yellow developing device and primarily transferred onto the intermediate transferring belt 6. Note that the dot toner image forming means is composed of the dot toner image forming unit 17, the exposure apparatus 3, the photosensitive drum 1, the charger 2, the yellow developing device 5Y, and the like.

The data for the dot toner image is controlled such that the dot toner image is within at least the primary transferring nip part B while the electrostatic latent image for the toner image of the first color is formed by the laser beam exposure. That is, the leading end of the dot toner image comes before the leading end of the toner image of the first color (on the downstream side in the moving direction of the photosensitive drum). A trailing end of the dot toner image may pass through the primary transferring nip part after the completion of the exposure for the formation of the electrostatic latent image for the toner image of the first color. However, as in this embodiment, it is preferable that the trailing end of the dot toner image comes after that of the toner image of the first color (on the upstream side in the moving direction of the photosensitive drum).

Through the above arrangement, at the time when the yellow toner image on the photosensitive drum 1 is primarily transferred onto the intermediate transferring belt 6, the dot toner image is intervened at the primary transferring nip part B. Thus, the image streak is prevented from occurring on the yellow toner image. In addition, when the toner images of a second color and its subsequent colors are formed on the photosensitive drum 1 with a magenta toner, a cyan toner, and a black toner and primarily transferred onto the intermediate transferring belt 6, the dot toner image with the yellow toner, which has been already held on the intermediate transferring belt 6, is intervened at the primary transferring nip part B. Accordingly, the image streak is prevented from occurring on the toner image of each color as well.

Also, although the dot toner image additionally formed independently of the image information that the user demands is secondarily transferred onto the transferring material in the end, in the image forming apparatus of this embodiment, the dot toner image is formed with the yellow toner and thus, relatively inconspicuous. Thus, it is possible to avoid the undesirable degradation of the final image quality.

(Regarding a Pattern Formed Using the Dot Toner Images)

Incidentally, to obtain a high-quality final image in a stable manner with respect to the various transferring materials and the image quality mode to be used or selected by the user, in the image forming apparatus of this embodiment, the dot toner images formed by the dot toner image forming means are used to constitute the different arrangement patterns according to a print mode as listed below, for instance.

(1) Plain paper mode: pattern A (2) Coat paper/glossy paper/glossy film mode and high image quality mode: pattern B The plain paper mode in the image forming apparatus of this embodiment means a print mode that the user is selected at the time of printing to the plain paper with a normal image quality.

On the other hand, the coat paper/glossy paper/glossy film mode means a print mode that the user is selected at the time of printing to the coat paper, the glossy paper, or the glossy film.

Those transferring materials have large basis weights (e.g., 110 g/m$^2$ or larger) and require the large heat quantity which the fixing device 15 needs to apply, for securing the satisfactory fixability. Thus, the printing (image formation) is performed on those transferring materials at the image formation speed half as high as the normal image formation speed. Note that the image formation speed corresponds to the moving speed of the first image bearing member and the second image bearing member, that of the transferring material at the secondary transferring nip part, and that of the transferring material at the fixing part.

Also the high image quality mode means a print mode that the user is selected at the time of printing to the various transferring materials with the image quality higher than usual, that is, with the more satisfactory fixability, glossiness, and resolution. Similarly, the printing (image formation) is performed on those transferring materials at the image formation speed half as high as the normal image formation speed.

Figure 5:
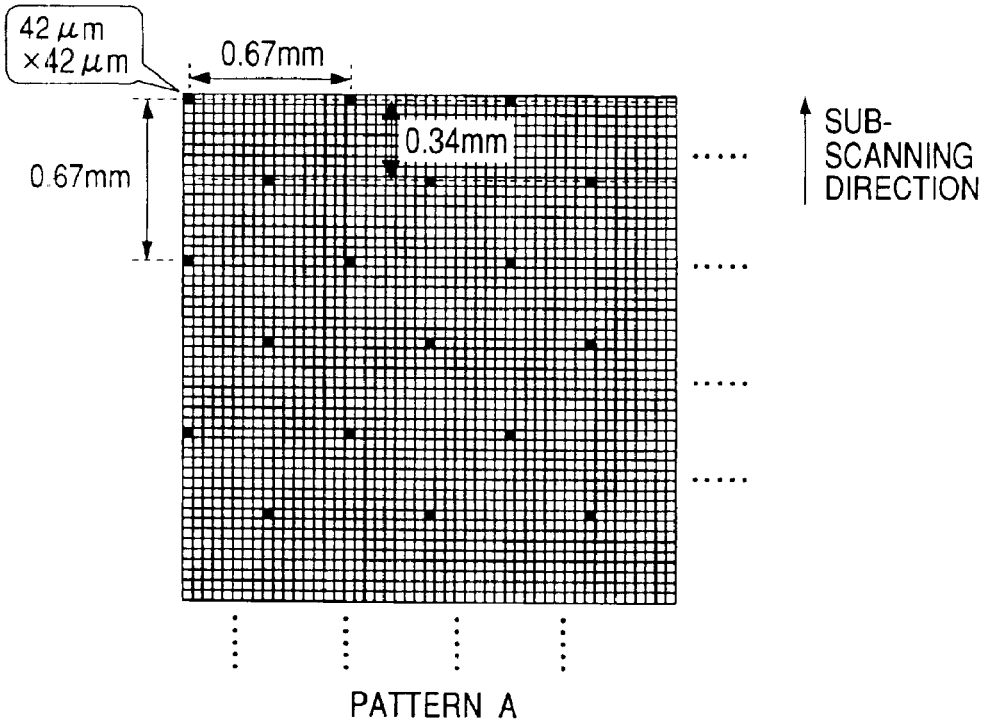
FIG. 5 shows a dot image arrangement pattern A.
Figure 6:
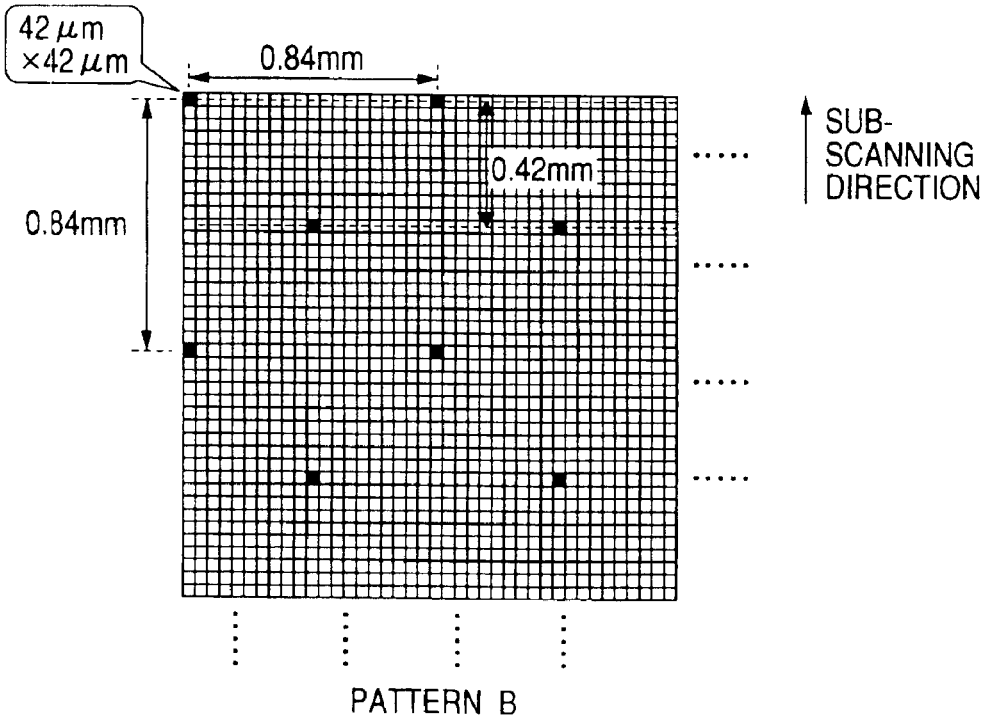
FIG. 6 shows a dot image arrangement pattern B.

Here, the dot toner image arrangements of the pattern A and the pattern B are shown in FIG. 5 and FIG. 6, respectively. In the figures, 1 block corresponds to 1 pixel (42 μm×42 μm). The data of solid black pixels in the figures is set to FFh, so that the minute dot toner images are formed at those positions.

As shown in FIGS. 5 and 6, in the patterns A and B, the dot toner images with a dot size approximately equal to 1 pixel are arranged at 45 degrees to the main scanning direction through the uniform dispersion. Thus, the frictional force between the photosensitive drum 1 surface and the intermediate transferring belt 6 surface is uniformly reduced throughout the surfaces. The dot toner images of either pattern are formed while overlapping with the entire region of the toner image of the image pattern that the user demands. The average printing ratio of the image data of the dot toner images in each pattern is 0.78% in the pattern A or 0.50% in the pattern B.

Note that for effectively suppressing the image streak occurrence on any image pattern, the dot toner images to be formed on the photosensitive drum 1 are formed while overlapping with the toner image portion on the upstream side in the sub-scanning direction of the image forming apparatus in the toner image of the image pattern that the user demands.

In the plain paper mode, using the pattern A, the dot toner images with the average printing ratio of 0.78% are formed for the image formation. Therefore, the image streak occurrence can be stably suppressed, and the additionally formed dot toner images are not conspicuous on the transferring material and the transferring material does not look discolored. As is apparent from studies by the inventors of the present invention using the various arrangement patterns, in this mode, the image streak occurrence can be stably suppressed as shown in Table 1, provided that the average printing ratio of the additionally formed dot toner images is about 0.78% or higher. In addition, with the proviso that the average printing ratio thereof is about 1.02% or lower, a situation can be avoided, in which the additionally formed dot toner images are conspicuous on the transferring material and the transferring material looks discolored.

TABLE 1

Level of image streak and discoloration of transferring material in plain paper mode

| Average printing ratio | Image streak | Discoloration of transferring material |
|---|---|---|
| 1.39% | ○ | Δ |
| 1.02% | ○ | ○ |
| 0.78% (Pattern A) | ○ | ○ |
| 0.62% | Δ | ○ |
| 0.50% (Pattern B) | x | ○ |
| 0.41% | x | ○ |
| 0.35% | x | ○ |
| 0% (No dot toner image) | x | ○ |

(○: Low level,
Δ: Slightly low level,
x: High level)

On the other hand, in the coat paper/glossy paper/glossy film mode, when the dot toner images are formed using the pattern A for the image formation, the additionally formed dot toner images are conspicuous on the transferring material. This is because the transferring material such as the coat paper, the glossy paper, or the glossy film is superior to the plain paper in surface smoothness and in secondary transferring property. Therefore, the dot toner image is wholly represented on the transferring material, which is primarily transferred onto the intermediate transferring belt.

Also, in the high image quality mode, when the dot toner images are formed using the pattern A for the image formation, the additionally formed dot toner images are similarly conspicuous on the transferring material. This is because the printing speed is reduced to thereby improve the fixability as well as the secondary transferring property. As a result, the yellow dot toner image fixed onto the transferring material supposedly appears with the increased surface glossiness.

As described above, even when the minute dot toner images are formed with the yellow toner through the uniform dispersion, the dot toner images are conspicuous on the transferring material one by one, with the result that the transferring material looks discolored in its entirety.

Thus, the coat paper/glossy paper/glossy film mode and the high image quality mode in the image forming apparatus of this embodiment, the dot toner images with the average printing ratio of 0.50% are formed using the pattern B for the image formation.

In this way, while the average printing ratio of the dot toner images is kept low, the number of dot toner images per unit area, which are additionally formed on the transferring material is decreased, making it possible to effectively avoid such a situation that the dot toner images are conspicuous on the transferring material and thus, the transferring material looks discolored.

As is apparent from studies by the inventors of the present invention using the various arrangement patterns, in those modes, provided that the average printing ratio of the additionally formed dot toner images is about 0.50% or lower, a situation can be avoided, in which the additionally formed dot toner images are conspicuous on the transferring material and the transferring material looks discolored.

Note that, in the coat paper/glossy paper/glossy film mode and the high image quality mode, the image formation is carried out at a speed half as high as a normal speed. The image streak occurrence level is slightly low relative to that of normal ones. Accordingly, even if the average printing ratio of the additionally formed dot toner images using the pattern B is kept low, the image streak occurrence can be effectively suppressed. As is apparent from studies by the inventors of the present invention using the various arrangement patterns, in those modes, as shown in Table 2, the image streak occurrence is stably suppressed with the proviso that the average printing ratio of the additionally formed dot toner images is about 0.41% or higher.

TABLE 2

Level of image streak and discoloration of transferring material in coat paper/glossy paper/glossy film mode and high image quality mode

| Average printing ratio | Image streak | Discoloration of transferring material |
|---|---|---|
| 1.39% | ○ | x |
| 1.02% | ○ | x |
| 0.78% (Pattern A) | ○ | x |
| 0.62% | ○ | Δ |
| 0.50% (Pattern B) | ○ | ○ |
| 0.41% | ○ | ○ |
| 0.35% | Δ | ○ |
| 0% (No dot toner image) | x | ○ |

(○: Low level,
Δ: Slightly low level,
x: High level)

In contrast, in the plain paper mode, when the dot toner images are formed with the average printing ratio of 0.50% using the pattern B for the image formation, the average printing ratio of the additionally formed dot toner images is insufficient, which makes it impossible to stably suppress the image streak occurrence.

Note that, the coat paper/glossy paper/glossy film mode of the image forming apparatus of this embodiment is a mode where the printing (image formation) is performed at a speed half as high as a normal speed. Among the transferring materials such as the coat paper, the glossy paper, and the glossy film, the material having a small basic weight (e.g., 105 g/m$^2$ or smaller) and the satisfactory fixability equivalent to the plain paper can also undergo printing at the normal speed. In this case, however, the average printing ratio of the additionally formed dot toner images should be about 0.78% or higher for stably suppressing the image streak occurrence and about 0.50% or smaller for avoiding the discoloration of the transferring material surface. Thus, it is difficult to meet both of them at the satisfactory level (see Table 3). However, also in such a case, as shown in Table 3, the average printing ratio of the additionally formed dot toner images is set to about 0.62% and both of them are maintained to the slightly low level (Δ level: no problem occurs in the actual use), thereby avoiding the remarkable reduction of the image quality.

TABLE 3

Level of image streak and discoloration of transferring material in printing on coat paper, glossy paper, or glossy film with small basic weight at normal speed

| Average printing ratio | Image streak | Discoloration of transferring material |
|---|---|---|
| 1.39% | ○ | x |
| 1.02% | ○ | x |
| 0.78% (Pattern A) | ○ | x |
| 0.62% | Δ | Δ |
| 0.50% (Pattern B) | x | ○ |
| 0.41% | x | ○ |
| 0.35% | x | ○ |
| 0% (No dot toner image) | x | ○ |

(○: Low level,
Δ: Slightly low level,
x: High level)

As described above in this embodiment, the dot toner images are formed independently of the predetermined image information, and the dot toner images with the toner of the first color are steadily intervened at the primary transferring nip part B. Therefore, the toner images primarily transferred onto the intermediate transferring belt 6 surface can be made free of the foregoing image streak in a stable manner.

At this time, the additionally formed dot toner image is transferred onto the image region undergoing the primary transfer of the toner image on the intermediate transferring belt 6 and transferred and fixed finally onto the transferring material. However, by changing the dot image according to the condition upon forming the toner image on the transferring material, that is, dot toner image arrangement pattern according to the print mode to change the average printing ratio, it is possible to effectively avoid such a situation that the dot toner images are conspicuous on the transferring material and the transferring material looks discolored, independently of the selection of the type of the transferring material or the image quality mode.

Note that the additional formation of the dot toner images as mentioned in this embodiment is particularly effective for the case where the intermediate transferring belt 6 rotates at a high surface peripheral velocity relative to the photosensitive drum 1 as in the image forming apparatus of this embodiment.

However, needless to say, also in the image forming apparatus in which the intermediate transferring belt 6 rotates at the surface peripheral velocity equal to or lower than that of the photosensitive drum 1, the dot toner images are additionally formed to make the photosensitive drum 1 surface and the intermediate transferring belt 6 surface smooth to each other to thereby reduce the frictional force in the same way. Thus, a rotation property of the photosensitive drum 1 or the intermediate transferring belt 6 can be stabilized to suppress the image streak occurrence. At the same time, it is possible to avoid such a situation that the transferring material looks discolored, independently of the selection of the type of the transferring material or the image quality mode, provided that the average printing ratio is changed according to the print mode.

(Embodiment 2)

This embodiment provides another example of the dot toner image as described in Embodiment 1 above. A structure of the image forming apparatus or the like is the same as in Embodiment 1.

The dot toner images described in Embodiment 1 vary in average printing ratio depending on the print mode, which is not, however, necessarily achieved by changing the dot toner image arrangement pattern. A feature of this embodiment is that the average printing ratio of the dot toner images formed for suppressing the image streak occurrence in addition to the image data varies by changing the dot size of the dot toner image.

Figure 7:
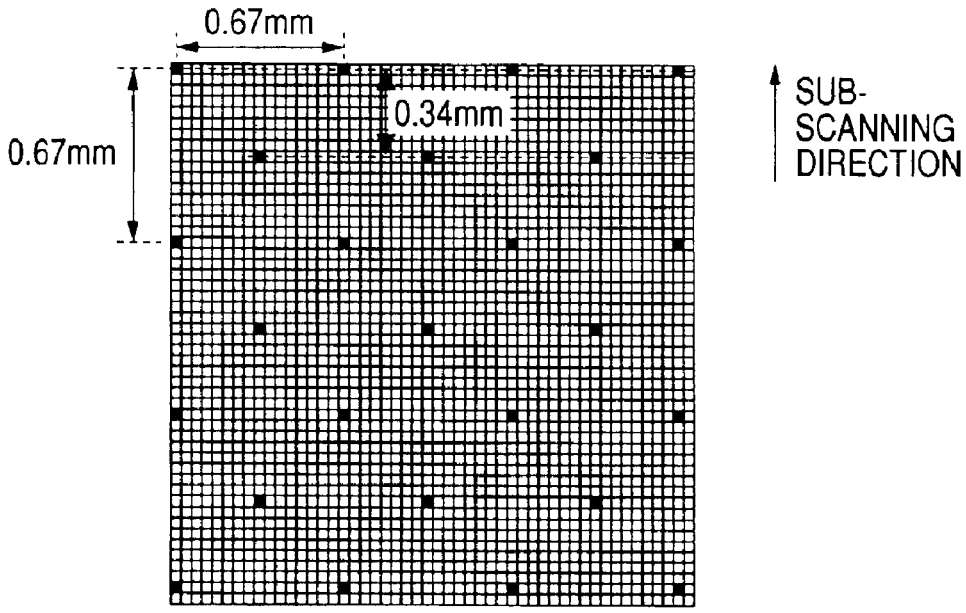
FIG. 7 shows a dot image arrangement pattern C.
Figure 8:
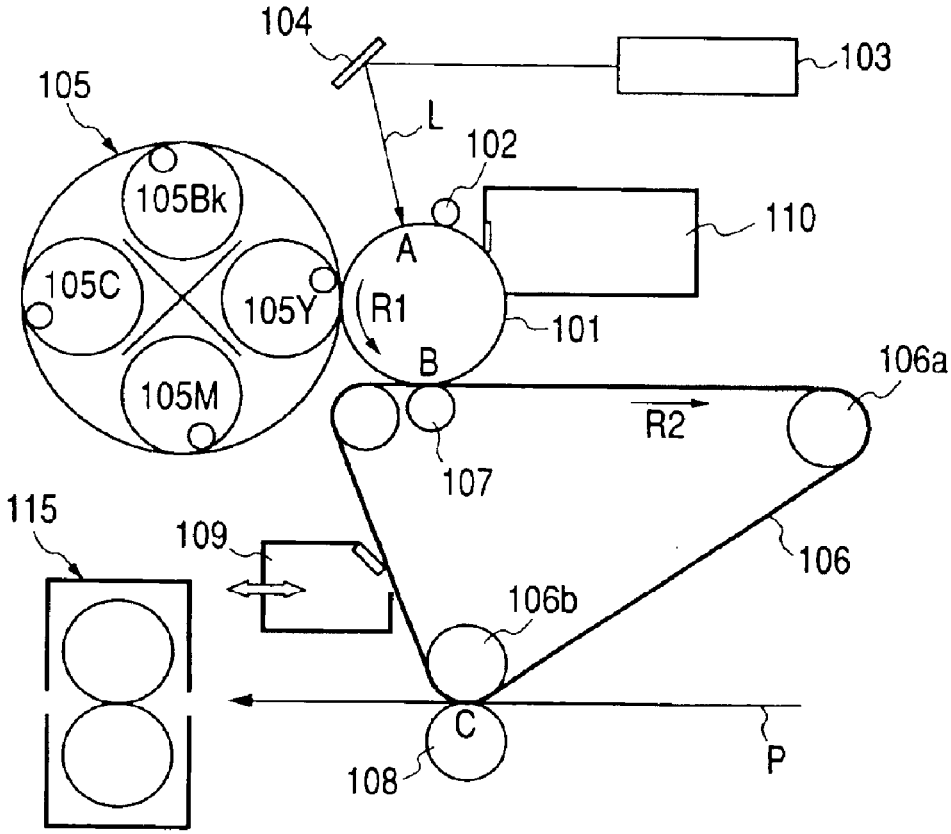
FIG. 8 shows a conventional image forming apparatus.

FIG. 7 shows a pattern C formed in this embodiment. In the image forming apparatus of this embodiment, the dot toner images constitute the arrangement pattern of the pattern A as mentioned in Embodiment 1 irrespectively of print mode. The data applied to the solid black pixels of FIG. 5 takes different values, for example, depending on the print mode as follows.

(1) Plain paper mode: FFh (2) Coat paper/glossy paper/glossy film mode and high image quality mode: A4h (pattern C)

At this time, in the coat paper/glossy paper/glossy film mode and the high image quality mode, by adjusting a laser illumination time through a pulse width modulation (PWM) control of the laser exposure L, the dot toner images formed using the pixel data of A4h at the above positions have a small dot size relative to those formed using the data of FFh in the plain paper mode (laser is illuminated constantly in the case of the pixel data of FFh; in the case of the pixel data taking the smaller value (hexadecimal number), the laser is illuminated for a short time in proportion to the data value). This equals that the average printing ratio of the image data of the dot toner images is reduced to about 0.50% as mentioned in Embodiment 1.

In the plain paper mode, similar to Embodiment 1, the pixel data of the dot toner image is set to FFh to form the dot toner images with the average printing ratio of 0.78% for the image formation. Therefore, the image streak occurrence can be stably suppressed and the additionally formed dot toner images are not conspicuous on the transferring material and the transferring material does not look discolored. As is apparent from studies by the inventors of the present invention using the various types of pixel data, in this mode, the image streak occurrence can be stably suppressed similarly to Embodiment 1, provided that the average printing ratio of the additionally formed dot toner images is about 0.78%. In addition, as shown in Table 4, with the above proviso, a situation can be avoided, in which the additionally formed dot toner images are conspicuous on the transferring material and the transferring material looks discolored.

TABLE 4

Level of image streak and discoloration of transferring material in plain paper mode

| Average printing ratio | Image streak | Discoloration of transferring material |
|---|---|---|
| 0.78% (FFh) | ○ | ○ |
| 0.62% (CBh) | Δ | ○ |
| 0.50% (A4h) | x | ○ |
| 0.41% (87h) | x | ○ |
| 0.35% (73h) | x | ○ |
| 0% (No dot toner image) | x | ○ |

(○: Low level,
Δ: Slightly low level,
x: High level)

On the other hand, in the coat paper/glossy paper/glossy film mode and the high image quality mode, the pixel data of the dot toner images is set to A4h to obtain the small dot size and the dot toner images with the average printing ratio of 0.50% are formed for the image formation. Thus, the image streak occurrence can be stably suppressed and at the same time, the situation can be avoided, in which the dot toner images are conspicuous on the transferring material and the transferring material looks discolored. As is apparent from studies by the inventors of the present invention using the various types of pixel data, also in those modes, the image streak occurrence can be stably suppressed similarly to Embodiment 1, provided that the average printing ratio of the additionally formed dot toner images is about 0.41% or higher. In addition, as shown in Table 5, with the proviso that the average printing ratio thereof is about 0.50% or smaller, the situation can be avoided, in which the additionally formed dot toner images are conspicuous on the transferring material and the transferring material looks discolored.

TABLE 5

Level of image streak and discoloration of transferring material in coat paper/glossy paper/glossy film mode and high image quality mode

| Average printing ratio | Image streak | Discoloration of transferring material |
|---|---|---|
| 0.78% (FFh) | ○ | x |
| 0.62% (CBh) | ○ | Δ |
| 0.50% (A4h) | ○ | ○ |
| 0.41% (87h) | ○ | ○ |
| 0.35% (73h) | Δ | ○ |
| 0% (No dot toner image) | x | ○ |

(○: Low level,
Δ: Slightly low level,
x: High level)

As described above in this embodiment, according to the print mode, the dot size of the dot toner image varies to change the average printing ratio. Also using such a method, independently of the selection of the type of the transferring material and the image quality mode, the image streak occurrence can be stably suppressed while the situation can be effectively avoided, in which the dot toner images are conspicuous on the transferring material and the transferring material looks discolored.

Note that as in this embodiment, the method of changing the average printing ratio of the dot toner images through the dot size change is particularly effective for the case where the stable developing characteristics are achieved in the developing device 5, and a toner amount for each dot toner image linearly varies depending on the dot size in a stable manner. Also with this method, it is sufficient that the number of patterns as the dot toner image arrangement pattern processed with the dot toner image forming unit is 1. As a result, the process for the dot toner image forming unit to add the data for the dot toner image to the image data can be simplified and achieved at a high speed as compared with the method of Embodiment 1.

Also, in the image forming apparatus of this embodiment, the dot size of the dot toner image is changed by the PWM control of the laser. Needless to say, however, in the case where the dot size is changed by modulation on a laser output intensity or spot size, or the like, the same effects can be obtained.

(Embodiment 3)

This embodiment provides another example of the dot toner images as described in Embodiment 1 above. A structure of the image forming apparatus or the like is the same as in Embodiment 1.

A feature of this embodiment is that the average printing ratio of the dot toner images formed in addition to the image data for suppressing the image streak occurrence varies depending on the environment surrounding the image forming apparatus or running conditions thereof (conditions of frequency of use). Hereinbelow, a detailed description thereof will be made taking as an example the additionally formed dot toner image in the plain paper mode in the image forming apparatus as described in Embodiment 1.

In the image forming apparatus of this embodiment, the dot toner image arrangement pattern in the plain paper mode is set to either the pattern A (average printing ratio: 0.78%) or the pattern B (average printing ratio: 0.50%), based on environment information obtained by a built-in environment sensor 18 of the image forming apparatus or information on the running conditions of the developing devices 5Y to 5Bk of the image forming apparatus. In either pattern, the data of the solid black pixels in FIGS. 5 and 6 is set to FFh.

Table 6 below is a table example used for changing the dot toner image arrangement pattern according to the surrounding environment (temperature/humidity) and the running conditions of the developing devices 5Y to 5Bk (0%: initial stage through 100%: after printing of 20 kp. in terms of A4 paper in total).

TABLE 6

Dot toner image arrangement pattern used under each environment/running condition

| Environment/ running condition | 0% | 25% | 50% | 75% | 100% |
|---|---|---|---|---|---|
| 15° C. · 10% Rh | Pattern A | Pattern A | Pattern A | Pattern A | Pattern B |
| 23° C. · 60% Rh | Pattern A | Pattern A | Pattern B | Pattern B | Pattern B |
| 30° C. · 80% Rh | Pattern B | Pattern B | Pattern B | Pattern B | Pattern B |

The following are apparent from Table 6. That is, as the temperature and humidity become higher (environment) or the developing devices 5Y to 5Bk run more (running condition), the pattern B with the low average printing ratio is selected with the increased frequency. This is because, under the high temperature and humidity environment or under the running conditions that the developing devices 5Y to 5Bk run more, in which toner triboelectricity is decreased an amount of the toner adhering onto the photosensitive drum 1 or the intermediate transferring belt 6 and causing a fogged image increases, thereby reducing the frictional force between the photosensitive drum 1 and the intermediate transferring belt 6 at the primary transferring nip part B. As a result, even if the dot toner images with the low average printing ratio are used, the image streak occurrence can be stably suppressed.

Table 6 is thus prepared assuming in advance the dot toner images with the minimum average printing ratio required for stably suppressing the image streak occurrence according to the environment or the running condition of the developing devices 5Y to 5Bk.

By forming the dot toner images using the pattern obtained with reference to such tables, according to the environment or the running condition of the developing devices 5Y to 5Bk, the image formation can be performed constantly using the dot toner images with the minimum average printing ratio. The image streak occurrence can be stably suppressed while the toner consumption necessary for the dot toner image formation can be kept minimum. Therefore, the user is not so often required to replace the developing devices etc. with new ones.

Further, also according to a change in surface characteristics (surface energy, surface roughness, etc.) of both the photosensitive drum 1 and the intermediate transferring belt 6 based on the running condition of both of them, in addition to the running conditions of the developing devices 5Y to 5Bk, the frictional force between the photosensitive drum 1 and the intermediate transferring belt 6 at the primary transferring nip part B may vary. Also in this case, the same effect can be achieved with the following proviso. That is, any table is prepared for changing the dot toner image arrangement pattern based on the information on the running conditions of the developing devices 5Y to 5Bk, the photosensitive drum 1, and the intermediate transferring belt 6 of the image forming apparatus and reference is made of the table for the image formation.

As described above in this embodiment, according to the environment surrounding the image forming apparatus or the running condition of the image forming apparatus, the average printing ratio of the dot toner images is changed. Thus, the image streak occurrence can be stably suppressed, while the toner consumption required for the dot toner image formation can be kept minimum. As a result, the user is not so often required to replace the developing devices etc. with new ones.

Note that even if the dot toner image arrangement pattern and the average printing ratio of the image data of the dot toner image defined according to the pixel data thereof are the same, there is a possibility that the toner amount for each dot toner image is changed due to a variation of developing characteristics according to the environment or the running conditions, and the effect of the additionally formed dot toner image is not the same. In this case as well, however, with the following proviso, the image streak occurrence can be stably suppressed, while the toner consumption required for the dot toner image formation can be kept minimum and hence, the user is not so often required to replace the developing devices etc. with new ones. That is, the average printing ratio of the dot toner images is changed while assuming the change in developing characteristics in advance according to the environment or the running condition such that the dot toner images with the minimum average printing ratio are constantly used for the image formation.

Also, the environment information of this embodiment is obtained with the built-in environment sensor of the image forming apparatus but can be obtained with other means. For example, in the case where an electric resistance of the intermediate transferring belt 6, the primary transferring roller 7, and the secondary transferring roller 8 depends on the environment, a mechanism for detecting the resistance is provided to thereby obtain the environment information.

On the other hand, as for the information on the running conditions of the developing devices 5Y to 5Bk, the photosensitive drum 1, and the intermediate transferring belt 6, in addition to a case where the information is stored in a memory provided in each member or the image forming apparatus, the information is stored in a driver inside a personal computer for activating the image forming apparatus in some cases.

Note that in the respective embodiments, it is assumed that upon changing the average printing ratio of the dot toner images, the image streak occurrence level is extremely low. In such a situation, the image forming apparatus can be set as follows: the average printing ratio of the dot toner images is changed to 0%, i.e., the additional formation of the dot toner images is stopped.

Also, according to the image pattern that the user demands as the final image, independently of the selection of the type of the transferring material or image quality mode, the environment surrounding the image forming apparatus, the running condition of the image forming apparatus, etc., the foregoing image streak occurrence level is extremely low in some cases. For example, in the case of the image pattern mainly including text data, even if the printing is performed without additionally forming the dot toner images, the image streak occurrence level remains extremely low and the image quality is less degraded. In such cases, the image forming apparatus can be set as follows: the average printing ratio of the additionally formed dot toner images is changed to a small value or the additional formation of the dot toner images is stopped by manual setting of the user or by automatically detecting the image pattern in the image processing unit.

As described above, according to the present invention, the dot toner images are formed independently of the predetermined image information, and the dot toner images with the toner of the first color are steadily intervened at the primary transferring nip part. Therefore, the toner images primarily transferred onto the surface of the second image bearing member such as an intermediate transferring belt can be made free of the image streak in a stable manner.

At this time, the additionally formed dot toner image is transferred onto the image region undergoing the primary transfer of the toner image on the second image bearing member and transferred and fixed finally onto the transferring material. However, by changing dot toner image arrangement pattern and dot size according to the print mode to change the average printing ratio, it is possible to effectively avoid such a situation that the dot toner images are conspicuous on the transferring material and the transferring material looks discolored, independently of the selection of the type of the transferring material or the image quality mode.

The embodiments of the present invention have been explained so far, but the present invention is by no means limited to those embodiments and any modification is allowable without departing from a technical concept of the present invention.

What is claimed is:

1. An image forming apparatus comprising:

a movable first image bearing member on which a toner image is formed; and a movable second image bearing member, which comes into contact with said first image bearing member and onto which the toner image on said first image bearing member is transferred, wherein the toner image on said second image bearing member is transferred onto a transferring material, and the transferring material displays the toner image, wherein a dot-shaped dot image formed of a toner different from the toner image is formable on said first image bearing member, and wherein the dot image is variable according to a condition in transferring the toner image onto the transferring material.

2. An image forming apparatus according to claim 1, wherein an average printing ratio of the dot image varies according to the condition.

3. An image forming apparatus according to claim 1, wherein an arrangement of dots forming the dot image varies according to the condition.

4. An image forming apparatus according to claim 1, wherein a dot size of the dot image varies according to the condition.

5. An image forming apparatus according to claim 1, wherein the condition is a type of the transferring material.

6. An image forming apparatus according to claim 5, wherein the type of the transferring material is based on a surface property of the transferring material.

7. An image forming apparatus according to claim 1, wherein the condition is an image forming speed.

8. An image forming apparatus according to claim 7, wherein the image forming speed is a moving speed of said first image bearing member and said second image bearing member.

9. An image forming apparatus according to claim 7, wherein the toner image on said second image bearing member is transferred onto the transferring material at a transferring part, and said image forming speed is a moving speed of the transferring material at the transferring part.

10. An image forming apparatus according to claim 7, wherein the toner image on said second image bearing member is transferred onto the transferring material, the toner image on the transferring material is fixed onto the transferring material at a fixing part, and the image forming speed comprises a moving speed of the transferring material at the fixing part.

11. An image forming apparatus according to claim 1, wherein the condition is an environment condition.

12. An image forming apparatus according to claim 1, wherein the condition is a condition of a frequency of use of the image forming apparatus.

13. An image forming apparatus according to claim 1, wherein the condition is a condition of the toner image.

14. An image forming apparatus according to claim 1, wherein, in a moving direction of said first image bearing member, a leading end of the dot image is on a downstream side of a leading end of the toner image and a trailing end of the dot image is on an upstream side of a trailing end of the toner image.

15. An image forming apparatus according to claim 1, wherein the dot image is formed of a yellow toner.

16. An image forming apparatus according to claim 1, wherein the toner image is formed corresponding to each color of a plurality of colors and the dot image is formed while being superimposed on a first color toner image formed on the first image bearing member.

17. An image forming apparatus according to claim 1, wherein said first image bearing member and said second image bearing member differ in a moving speed at a contact part between said first image bearing member and said second image bearing member.

18. An image forming apparatus according to claim 1, wherein said first image bearing member comprises a photosensitive member and said second image bearing member comprises an intermediate transferring member.

19. An image forming apparatus according to claim 1, wherein the dot image is formed according to information different from information for forming the toner image, which a user demands.

20. An image forming apparatus according to claim 1, wherein the transferring material does not display substantially the dot image.

21. An image forming apparatus according to claim 1, wherein the dot image is invisible to a user.

* * * * *

UNITED STATES PATENT AND TRADEMARK OFFICE

CERTIFICATE OF CORRECTION

PATENT NO. : 6,956,594 B2
DATED : October 18, 2005
INVENTOR(S) : Kenichi Iida et al.

It is certified that error appears in the above-identified patent and that said Letters Patent is hereby corrected as shown below:

Title page,
Item [73], Assignee, "Canon Kabushik Kaisha" should read -- Canon Kabushiki Kaisha --.

Signed and Sealed this

Sixth Day of June, 2006

JON W. DUDAS
*Director of the United States Patent and Trademark Office*